US005727070A

United States Patent [19]

Coninx

[11] Patent Number: 5,727,070

[45] Date of Patent: Mar. 10, 1998

[54] HEARING-AID SYSTEM

[76] Inventor: Paul Coninx, 5721 Terrebonne Street, Montreal, Quebec H4A 1A9, Canada

[21] Appl. No.: 727,325

[22] Filed: Oct. 8, 1996

Related U.S. Application Data

[63] Continuation of Ser. No. 240,911, May 10, 1994, abandoned.

[51] Int. Cl.[6] ..... H04R 25/00

[52] U.S. Cl. ..... 381/68.4; 381/68.2; 381/68

[58] Field of Search ..... 381/60, 68, 68.2, 381/68.4, 1, 24, 25, 26, 28, 74, 92, 104, 109, 98, 103; 73/585; 345/33, 34, 38, 39; 455/226.4, 155.1, 158.2, 158.4

[56] References Cited

U.S. PATENT DOCUMENTS

| | | | |
|---|---|---|---|
| 537,026 | 4/1895 | Horst . | |
| 4,270,196 | 5/1981 | Terzian | 345/33 |
| 4,400,586 | 8/1983 | Hanscom | 379/77 |
| 4,531,229 | 7/1985 | Coulter | 381/68 |
| 4,890,332 | 12/1989 | Takahashi | 455/226.4 |
| 4,918,736 | 4/1990 | Bordewijk | 381/68 |
| 4,947,432 | 8/1990 | Topholm | 381/68.2 |
| 5,086,464 | 2/1992 | Groppe | 379/430 |
| 5,191,190 | 3/1993 | Dodson | 345/39 |

*Primary Examiner*—Huyen D. Le

*Attorney, Agent, or Firm*—Hayes, Soloway, Hennessey, Grossman & Hage P.C.

[57] ABSTRACT

A hearing-aid device and that permits individuals other than the wearer of the hearing-aid to monitor and adjust one or more of the various characteristics (e.g., amplification, tonal quality, etc.) of sound provided to the wearer. The hearing-aid system of the present invention includes a small, sound input unit, a hand-held remote control unit, and a pair of stereophonic earphones. The sound input unit includes a pair of stereophonic microphones for sensing sound in the ambient environment. Each of the microphones are connected to respective controllable amplifier means for controllably amplifying and/or otherwise modifying the sound sensed by the microphones. The remote control unit is connected to the input unit and has a parameter adjustment means for controlling various functional parameters of the system. The parameter adjustment means includes volume adjustment means for controlling the degree of amplification applied to sound sensed by the microphone means. The headphones are connected to the system and receive amplified electrical audio signals from the amplifier means. The volume adjustment means includes separate means for respectively increasing and decreasing the volume of sound reaching the wearer of the stereophonic headphones, and volume indicator means for visibly displaying an indication of the volume level of amplified sound reaching the wearer of the headphones.

19 Claims, 6 Drawing Sheets

LED/LCD
26A
26B
26
driver
28
jack
aux
12
52
in
amp
20A
digital
gain
control
24
amp
20B
16A
right
mic
18
16B
left
B+
38
Mic/amp
10
main
jack
30
jack
aux
Out
32
up/down pulse
audio output
36
modular
cable
main
jack
Hand-held
remote
control
34
14
44U
up
44
42
down
44D
jack
50
headphones
16

LED/LCD
26B
26
26A
12
driver
28
jack
aux
52
In
amp
20A
18A
right
mic
18
digital
gain
control
24
main
jack
30
audio output
up/down pulse
32
amp
20B
18B
left
102
B+
38
jack
aux
Out
modular
cable
36
main
jack
Hand-held
remote
control
34
14
44U
up
44
42
down
44D
jack
50
headphones
16
100
102
Mic/amp
10 modular cable
36
main jack
Hand-held remote control
34
14
headphones
16
50
audio output
up/down pulse
32
jack
44U
up
44
42
down
44D
main jack
30
jack aux
Out
26B
26
LED/LCD
26A
driver
28
digital gain control
24
20A
amp
20B
amp
B+
38
Mic/amp
10
12
300
jack aux
in
52
18A
right
mic
18
18B
left

HEARING-AID SYSTEM

This is a continuation of application(s) Ser. No. 08/240,911 filed on May 10, 1994, now abandoned.

BACKGROUND OF THE INVENTION

1. Field of the Invention

The present invention relates generally to a hearing-aid system, and more specifically, to a hearing-aid system that permits the wearer and/or people other than the wearer to easily monitor and control one or more of the various characteristics (e.g., the degree of sound amplification, tonal quality, etc.) of sound provided to the wearer by the system and that overcomes problems associated with severe background noise. Other utilities are also contemplated for the instant invention.

2. Brief Description of Related Art

The prior art is replete with small, battery powered hearing-aids and amplifiers for use by hearing-impaired people to assist them in better hearing speech and/or ambient sound. To the best of my knowledge, however, no hearing-aid system exists that permits both the wearer of the hearing-aid and individuals other than the wearer to easily monitor and control characteristics of the sound provided to the wearer.

This is unfortunate because in many situations and/or environments it would be desirable for someone other than the wearer of the hearing-aid to be able to easily monitor and/or control its functional parameters (e.g., volume level, tone, etc.). For example, when a non-hearing-impaired person attempts to communicate and/or converse with a hearing-impaired individual who also happens to be physically and/or mentally impaired or infirm, it is often the non-hearing-impaired person who must bear at least some of the burden of adjusting and/or controlling the degree of sound amplification provided to the hearing-impaired individual by the hearing aid, since the hearing-impaired individual may find it difficult or impossible to perform this task without outside assistance. In such situations, it is difficult for the person adjusting the amplification to know when it has reached an optimal level, since no immediate, readily observable external and/or objective measure of sound volume is provided, and the wearer of the hearing-aid often is incapable of providing such information or otherwise chooses not to do so. Yet, if the amplifier gain is set too high, it may cause discomfort or pain to the listener; if too low, it may result in loss of the capacity of the listener to properly hear and comprehend what is being said. In the face of these difficulties, the use of an electronic amplifier is often foregone entirely and a severely limited form of communication takes placed by speaking to the hearing-impaired person very slowly, repetitively, and in a loud voice.

Further complicating the task of adjusting the functional parameters of the hearing-aid is the fact that modern miniaturized hearing-aids have tiny control knobs and buttons that are placed close together and/or are otherwise hard to adjust. Also, ambient sound volume and/or background noise may change significantly during the course of use of the hearing-aid, thereby necessitating repeated adjustment of the hearing-aid's controls over time. Such repeated adjustment of the tiny, hard to adjust controls, is time consuming and can be frustrating for all concerned.

Additionally, in most conventional hearing-aids the microphone pickup is located adjacent the earphone. This type of configuration can lead to significant disadvantages. For example, in noisy environments, if volume is increased to allow recognition of a particular sound or sounds by amplifying same, then background noise is also amplified proportionally. In circumstances where the background noise is severe and/or the sound desired to be amplified is weak, this phenomenon can effectively render the hearing-aid useless, since the particular sound or sounds intended to be heard will be obscured by background noise.

Finally, it is important not to overlook the psychological effects that the foregoing type of situation can have upon those involved. The hearing-impaired person often feels that he or she has become a burden to the individual assisting him or her in adjusting the often unwieldy controls of the hearing-aid, while the person assisting the hearing-impaired person often feels frustration at having to repeatedly adjust the controls of the hearing-aid over time while being forced to find the optimal setting for the hearing-aid through guesswork and without receiving any clear indication of the results of the changes made during the adjustment process. These sentiments can serve to emotionally isolate the hearing-impaired from the non-hearing-impaired.

Examples of conventional hearing-aid devices are disclosed in, e.g., Bordewijk, U.S. Pat. No. 4,918,736 (1990); T Phoml, U.S. Pat. No. 4,947,432 (1990); and, Groppe, U.S. Pat. No. 5,086,464 (1992). All of the conventional hearing-aid devices disclosed in these patents suffer from the aforesaid (and other) disadvantages and drawbacks.

It is therefore a general object of the present invention to provide a portable hearing-aid system that overcomes the aforesaid and other disadvantages and drawbacks of the prior art, and more specifically, that permits people other than the wearer of the system to easily monitor and adjust the degree of sound amplification supplied to the wearer by the system, and that overcomes problems associated with severe background noise.

SUMMARY OF THE INVENTION

The hearing-aid system of the present invention comprises a small, easily positioned (i.e., essentially hand-held) sound input unit, a relatively small, (i.e., essentially hand-held) remote control unit, and a pair of earphones. The sound input unit includes a pair of microphones for sensing sound in the ambient environment. The microphones are connected to respective controllable amplifier means for controllably amplifying and/or otherwise modifying the sound sensed by the microphones. The remote control unit is connected to the input unit and has parameter adjustment means for controlling various functional parameters of the system. The parameter adjustment means includes volume adjustment means for controlling the degree of amplification supplied to sound sensed by the microphone means. The headphones are connected to the system and receive amplified audio electrical signals from the amplifier means representative of amplified ambient sound. The volume adjustment means includes separate means for volume adjustment, preferably two push-buttons, which serve to increase and decrease the volume of sound reaching the wearer of the stereophonic headphones, along with a volume indicator means for visibly displaying an indication of the volume level of amplified sound reaching the wearer of the headphones. In a preferred embodiment of the present invention, the volume level indicator means comprises a digital and/or analog display unit for indicating the volume level of amplified sound reaching the wearer's ears.

Advantageously, the hearing-aid system of the present invention permits people other than the wearer of the hearing-aid to easily monitor and adjust the various functional parameters of the system, including the volume level of sound amplified by the hearing-aid. Also, as an additional advantage, the preferred two-button volume adjustment means of the present invention permits all but the most physically impaired individuals to easily adjust the volume level of sound reaching the wearer's ears.

Further advantageously, in noisy environments, the remote microphone of the present invention may be placed adjacent the source of sound intended to be heard, thereby increasing the effective signal to noise ratio of the sound intended to be heard, and making recognition of the sound over the background noise much more easily accomplished.

Other features, advantages, and embodiments of the present invention will become apparent in the following Detailed Description of the Preferred Embodiments and upon reference to the Drawings.

DETAILED DESCRIPTION OF PREFERRED EMBODIMENTS

Figure 1:
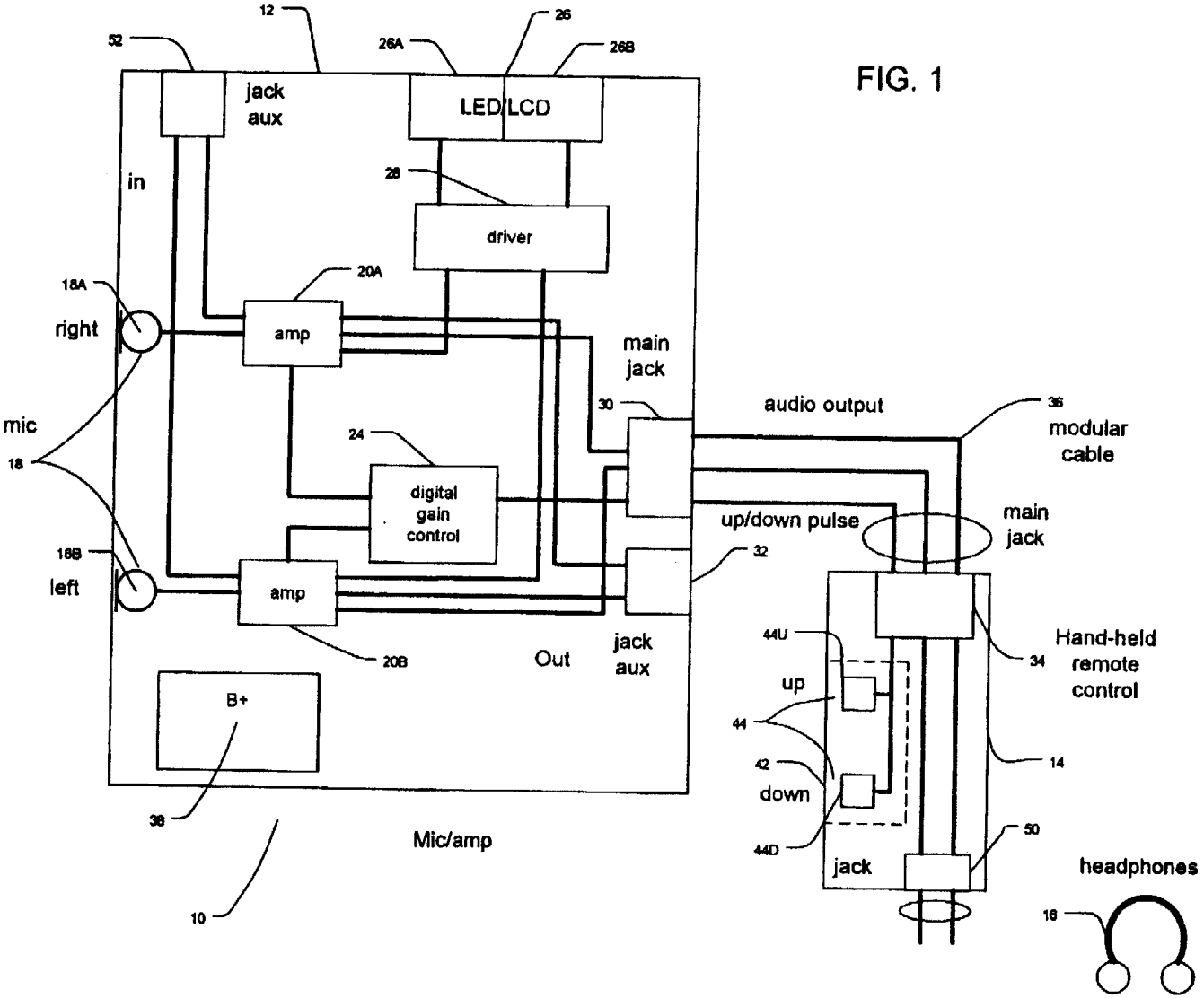
FIG. 1 is a schematic block diagram of one preferred embodiment of the present invention.
Figure 3:
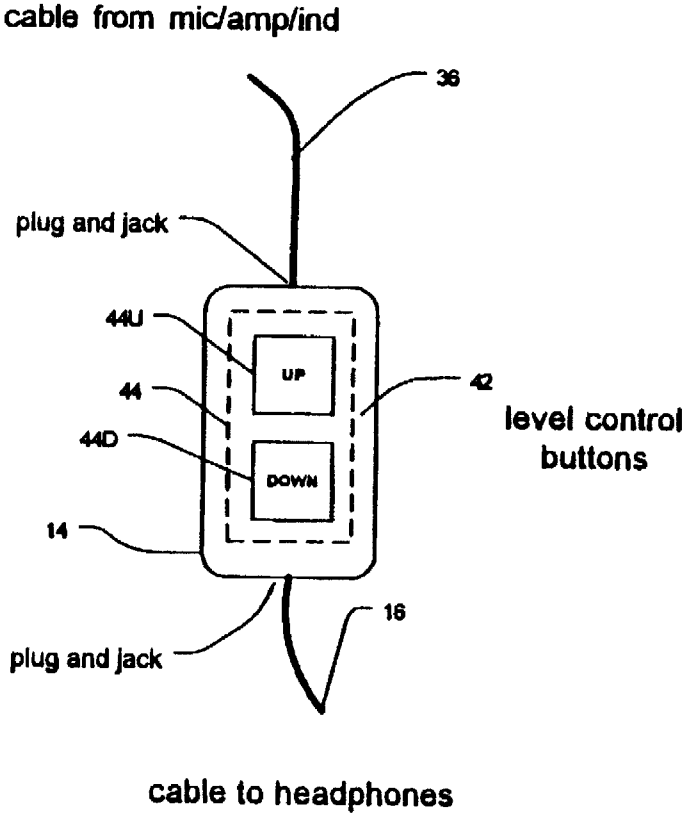
FIG. 3 is an outside, top plan view of the remote control unit of a preferred embodiment of the present invention, showing one embodiment of the volume adjustment means of the present invention.
Figure 2:
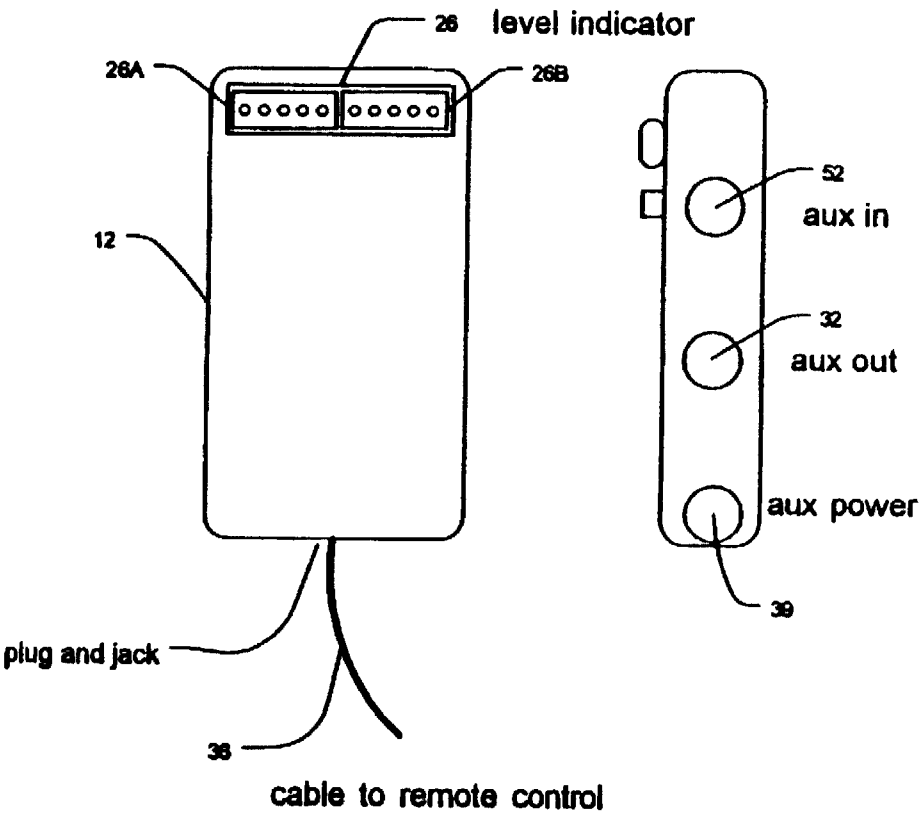
FIG. 2 is an outside, top plan view of the sound input unit of a preferred embodiment of the present invention.

Referring to FIGS. 1–3, system 10 (which is one preferred embodiment of a hearing-aid system made according to the present invention) essentially comprises a small, easily positioned (i.e., essentially hand-held) sound input unit 12, a hand-held remote control unit 14, and a pair of stereophonic earphones 16. All of the components of system 10 are preferably of conventional construction. The sound input unit 12 includes a pair 18 of stereophonic microphones 18A, 18B for sensing sound in the ambient environment in which the system 10 is located. Each of the microphones 18A, 18B is connected to respective controllable amplifier means 20A, 20B for controllably amplifying and/or otherwise modifying the sound of the ambient environment sensed by the microphones 18A, 18B to assist the wearer of headphones 16 in hearing the sound. Amplifiers 20A, 20B are controllable by gain control circuitry 24 and are connected to volume indicator means 26 via driver circuitry 28. Preferably, indicator means 26 comprises at least one display means 26A of the light emitting diode (LED) and/or liquid crystal display (LCD) type for displaying the power level at the outputs of amplifiers 20A, 20B, and thus, also the volume level of sound at the ears of the wearer of the earphones 16. Preferably, display means 26 comprises ten-segment bar-type display or a seven-segment numerical display, however, alternatively, display means 26 may comprise an analog meter (not shown) or other type of meter device. Other modifications of the display means are also possible. That is, preferably, the display 26A displays a number indicative of the volume level of ambient sound provided by the amplifiers 20A, 20B, respectively. Of course, many modifications of the indicator means 26 are possible. For example, other types and configurations of analog and/or digital displays may be used, so long as they permit individuals other than the wearer of the headphones 16 to visually monitor the status of sound provided to the wearer by the system 10. Furthermore, as shown in FIG. 2, the indicator means may be divided into two separate displays, 26A and 26B for separately displaying the volume level provided by each of the two amplifiers 20A, 20B, respectively.

Advantageously, the display means 26 of system 10 also permits determination of the dynamic range (i.e., the difference in volume level between background noise and the sounds intended to be amplified) of ambient sound sensed by microphones 18A, 18B. This may be accomplished by providing a separate indicator (not shown) indicating the dynamic range, however, inclusion of such separate means is usually unnecessary, since all that an observer of indicating means 26 need do in order to determine the dynamic range is to compare the volume level indicated by means 26 when the sound desired to be amplified is occuring, with the volume level indicated when the no such desired sounds are taking place.

Also included in sound input unit 12 is main input/output jack 30 for connecting the control and sound transmission circuitry of remote control 14 to input unit 12. More specifically, jack 30 includes means for permitting connection of remote control 14 to input unit 12 so as to enable the remote control 14 to control sound input unit 12 and to permit transmission of sound signals from amplifiers 20A, 20B to remote control unit 14. Preferably, in order to accomplish this, main jack 30 includes control connections to gain control circuitry 24 and audio connections to amplifiers 20A, 20B.

Additional stereophonic headphone output jack 32 is connected to amplifiers 20A, 20B and permits another person (i.e., a person other than the wearer of headphones 16) to connect another set of headphones (not shown) to system 10 to listen to the sound provided by system 10 to the wearer of headphones 16. Thus, system 10 permits the person adjusting sound parameters of the system 10 for another person to also experience the changes made to the sound. Advantageously, this feature further reduces the risk of injury and/or discomfort to the individual for whom sound parameters of the system 10 are being adjusted, due to, e.g., setting the volume level too high, etc.

Figure 8:
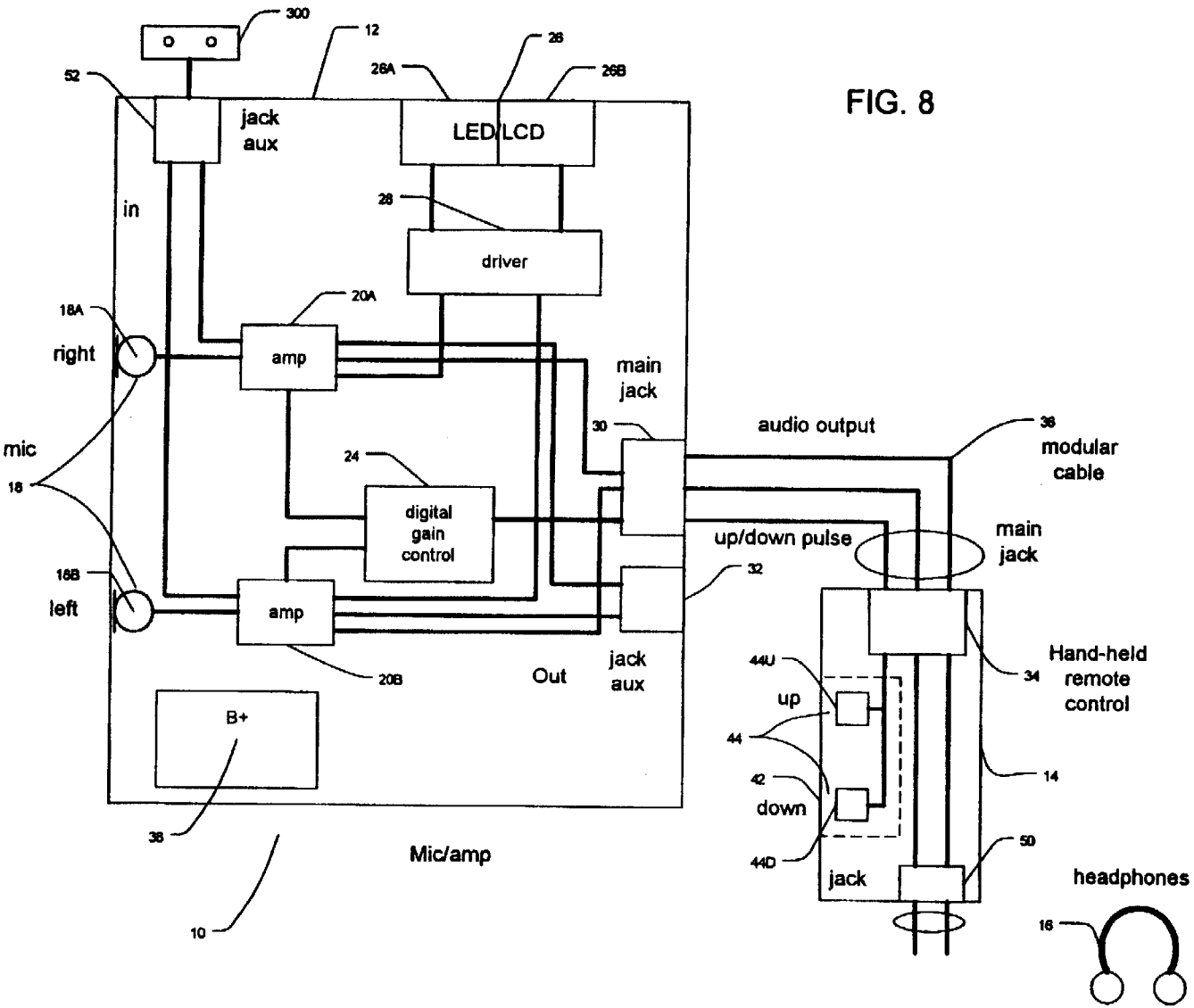
FIG. 8 is a schematic block diagram of an additional preferred embodiment of the present invention.

Remote microphone jack 52 permits connection of alternative stereo or monaural sound sources, such as external amplifiers, sound processors, and/or another set of remote microphones (300, as shown in FIG. 8), to the inputs of amplifiers 20A, 20B. Advantageously, jack 52 also permits input of multiple sound sources to the amplifiers to permit, e.g., greater ease of conversation among multiple people in a noisy environment.

Preferably, power supply means 38 is included in sound input unit 12 for supplying power to system 10. Preferably, power supply means 38 includes replaceable DC battery means (not shown) but, alternatively, may include AC adapter means 39 for drawing power from a conventional AC power network (not shown).

Remote control unit 14 includes control input/output jack 34 for connecting remote control unit 14 to sound input unit 12 via electrical cable 36. Jack 34 includes connections to headphone jack 50 and to parameter adjustment means 42, to permit transmission of sound signals to headphones 16, and control signals from the adjustment means 42, respectively- Parameter adjustment means 42 comprises volume adjustment means 44, which preferably consists of a pair of separate controls, i.e., push-buttons 44U, 44D for controlling gain control circuitry 24 to increase and decrease, respectively, volume of amplified sound supplied by system 10 (more specifically, by amplifiers 20A, 20B) to the wearer of the headphones 16 (and/or additional headphones connected to jack 32). In other words, the parameter adjustment means is designed to be readily accessible, and easily operated, by the user, and preferably employs individual inputs, 44U and 44D, for raising or lowering the supplied volume.

Push-buttons 44U, 44D are dimensioned to be easily accessible and usable, and more preferably, each have dimensions of at least ½ inch by ½ inch, and are separated from each other by a distance of at least ¼ inch. It should be understood that the shape and dimensions of push-buttons 44U, 44D are infinitely variable, and the foregoing dimensions are merely exemplary. Advantageously, the size and configuration of the volume adjustment means 44 is designed to permit simple and easy adjustment of volume supplied to the wearer of headphones 16 (and/or other headphones connected at jack 32) without reduction in functionality of the system 10. Any adjustments made by way of up-down push-buttons 44 to sound volume in system 10 is reflected automatically by indicator means 26.

Completing system 10 are headphones 16 which are connected to the remote control 14 via the headphone jack 50 so as to receive sound signals from amplifiers 20A, 20B.

Figure 4:
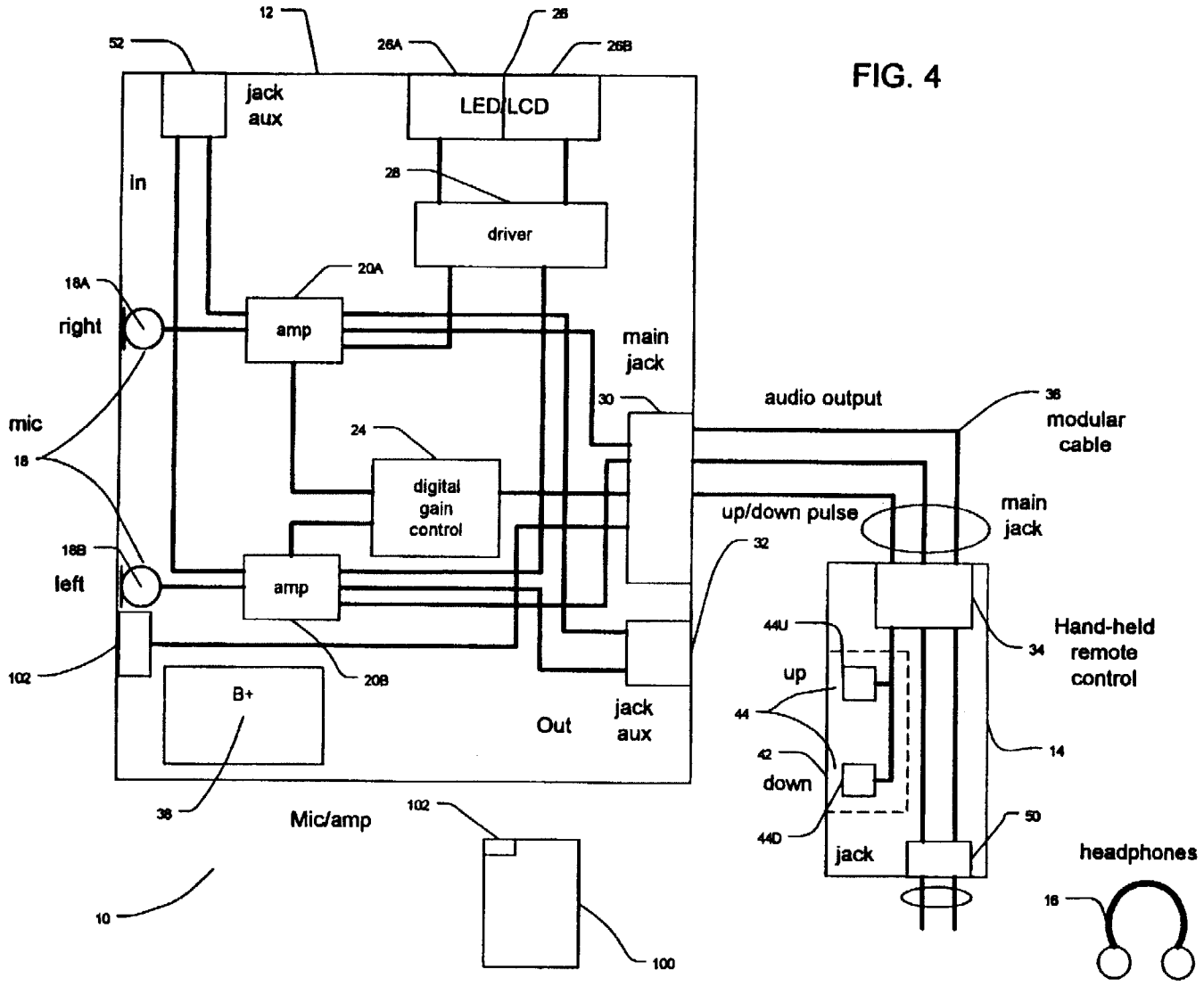
FIG. 4 is a schematic block diagram of another preferred embodiment of the present invention.

Thus, it is evident that there has been provided a hearing-aid system that fully meets both the aims and objectives hereinbefore set forth. It will be apparent to those skilled in the art that many modifications are possible to embodiment 10 without departing from the present invention. For example, as shown in FIG. 4 in order to further increase the ease with which an individual other than the wearer of the headphones 16 may adjust sound volume parameters and/or other functional parameters of the system 10, the system 10 may further comprise a second hand-held remote control unit 100 for remotely controlling the system. The second remote control 100 may control the system via conventional infrared and/or other types of wireless technologies. Alternatively, the second remote control may be directly coupled to the system. In either case, the second remote control may comprise means 102 for disabling or otherwise over-riding the ability of remote control 14 to control the system.

Furthermore functional parameter adjustment means 42 may comprise means for controlling sound and system parameters other than, and/or in addition to, volume. For example, adjustment means 42 may comprise tonal quality control means for controlling tonal quality of sound reaching the wearer of headphones 16. In this case, an additional indicator means, similar in structure and function to the volume indicator means 26 may be included to permit visual monitoring of the tonal quality of the sound.

Also, input unit 12 may comprise well-known conventional sound processing and/or background noise filtering circuitry, e.g., automatic gain control, clipping, frequency equalizer, and/or volume limiting circuitry. Other modifications may also be possible.

Figure 5:
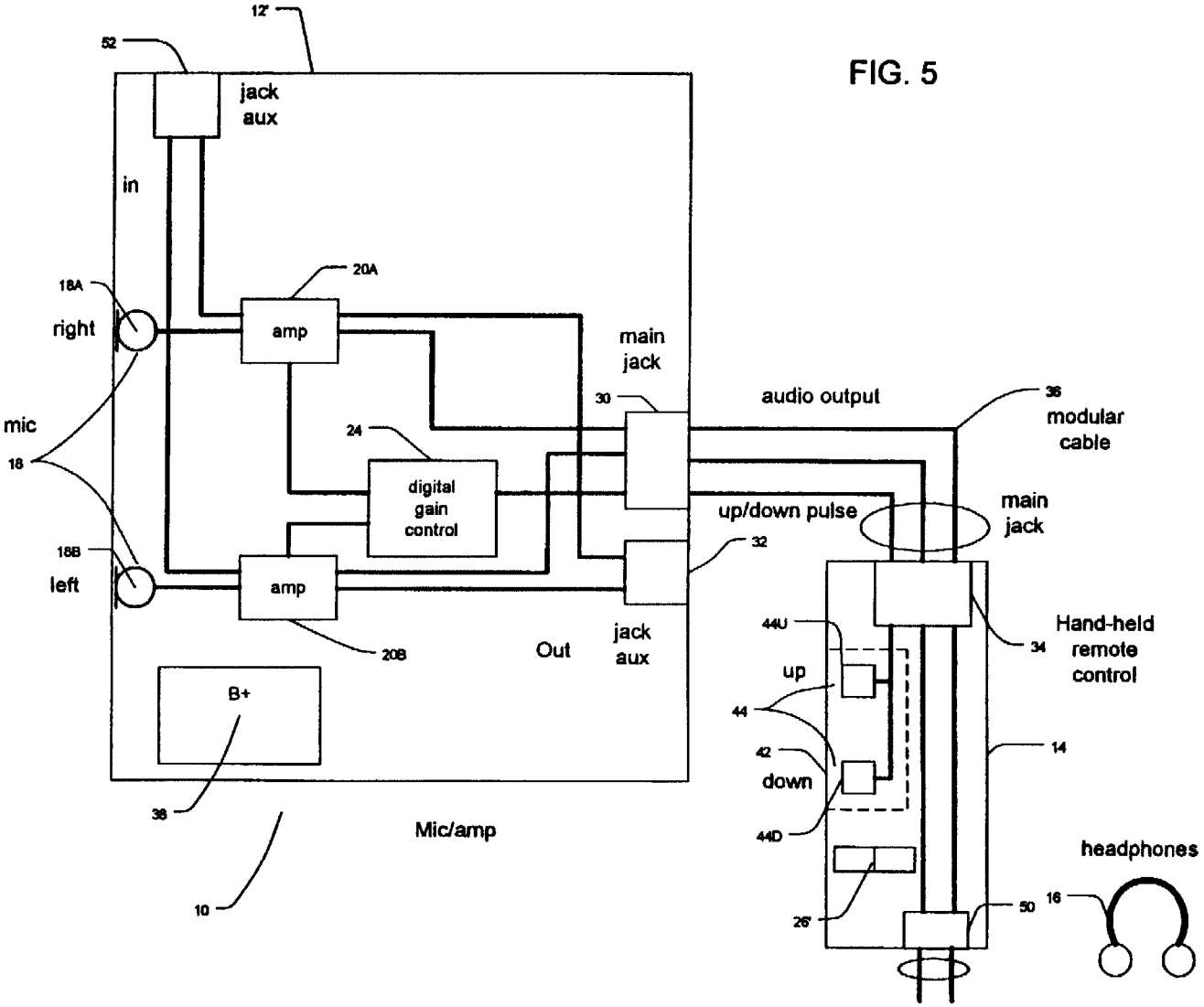
FIG. 5 is a schematic block diagram of yet another preferred embodiment of the present invention.
Figure 7:
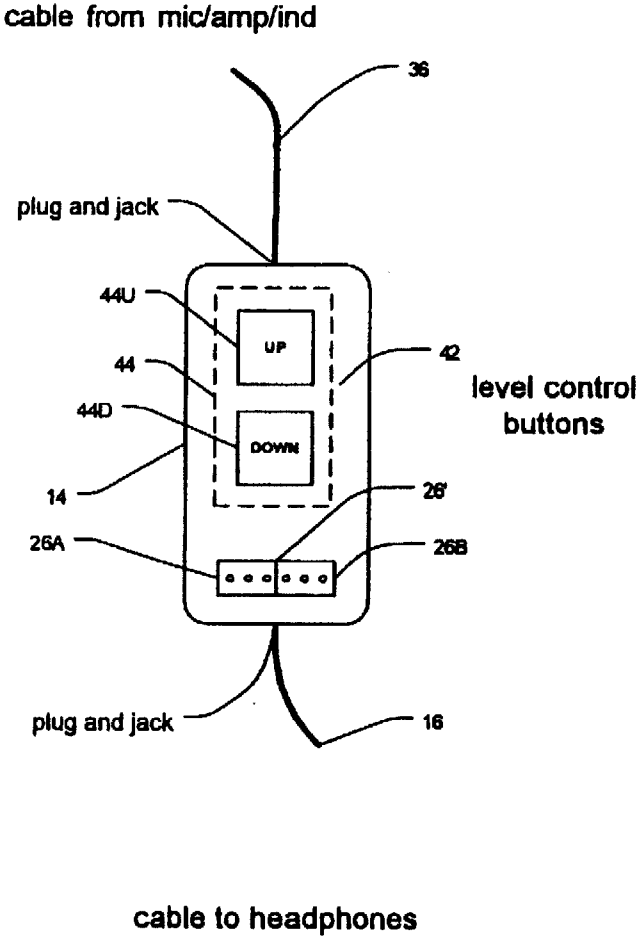
FIG. 7 is an outside, top plan view of the remote control unit of the preferred embodiment shown in FIG. 5.
Figure 6:
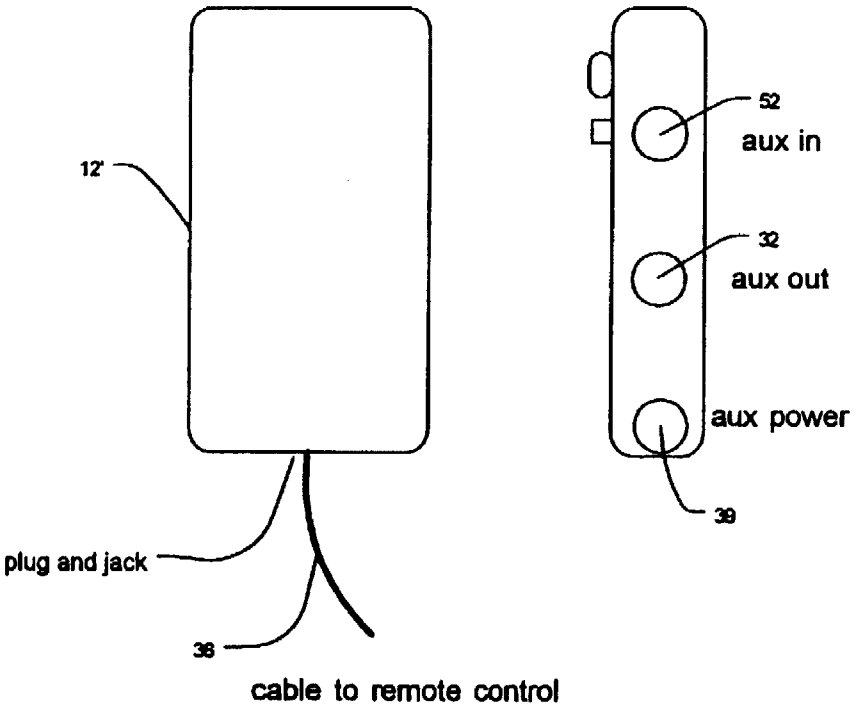
FIG. 6 is an outside, top plan view of the sound input unit of the preferred embodiment shown in FIG. 5.

For example, as shown in FIGS. 5–7, the indicator means 26' may be included in the hand-held remote control unit rather than in the sound input unit 12.

Additionally, although the system has been described as having two audio channels for providing stereophonic sound to the wearer of the headphones, the system may alternatively comprise only a single audio channel for providing to only one earphone. This can serve to reduce the cost of providing the system to a user e.g., one who has impaired hearing in one ear, and is totally without hearing in the other ear.

Thus, the present invention should not be viewed as being limited to the particular preferred embodiments. On the contrary, it is intended to encompass all such modifications, alternatives, variations, and equivalents as will be apparent to those skilled in the art. Thus, the present invention is intended to be limited only as it is defined in the hereinafter appended claims.

What is claimed is:

1. A hearing-aid system consisting essentially of:

a. a sound input unit including a pair of stereophonic microphones for sensing sound in an ambient environment, each of said microphones being connected to respective controllable amplifier means for controllably amplifying said sound sensed by said microphones;

b. a first hand-held remote control unit connected to said input unit, said control unit having functional parameter adjustment means including a digital volume controller for discrete stepwise control of said amplifier means so as to provide a single amplified volume of sound to be supplied in said system, said digital controller having separate means for increasing and decreasing said volume, said separate means having two push-buttons, one push-button being for increasing said volume and the other being for decreasing said volume, respectively; and c. a first pair of stereophonic headphones for being worn by a user, said headphones being connected to said system and receiving said single amplified volume of sound from said amplifier means;

wherein said sound input unit includes volume indicator means adapted to visibly display an indication of said single amplified volume of sound, said volume indicator means including display means connected to said amplifier means, said display means having a segmented, bar-type display for indicating the level of said single amplified volume of sound, said display including a plurality of individual bar segments and being adapted to display discrete stepwise changes in level of said single amplified volume of sound generated by said amplifier means, and said system further comprises a provision for an additional pair of headphones connected in parallel with said first pair of headphones to said system and receiving the single amplified volume of sound received by said first pair of headphones, said volume indicator means and said additional pair of headphones thereby permitting a person other than said user to monitor the amplified volume of sound being received by said first pair of headphones, said system being constructed such that said system is able to supply to said pairs of headphones only said single amplified volume of sound.

2. A system according to claim 1, wherein said volume indicator means includes display means connected to said amplifier means.

3. A system according to claim 2, wherein said display means displays a numeral indicative of said single amplified volume of sound.

4. A system according to claim 3, wherein said display means comprises a LED connected to line-driver circuitry.

5. A system according to claim 1, further comprising a second hand-held remote control unit for controlling said amplifier means, so as to adjust the volume of said simple amplified volume of sound being received by said pairs of headphones.

6. A system according to claim 1, wherein said input unit also includes wireless control signal receiving means and said system further comprises at least one other hand-held remote control unit for controlling said amplifier means by wirelessly transmitting control signals to said input unit, said other remote control having means for disabling ability of said first control unit connected to said input unit to control said system, said other remote control unit being for adjusting the single amplified volume of sound received by said pairs of headphones.

7. A system according to claim 1, and further comprising, power supply means for supplying power to said system.

8. A system according to claim 7, wherein said power supply means comprises battery means housed in said input unit.

9. A system according to claim 1, wherein said headphones, input unit, and remote control unit are connected to each other by electrical cable means.

10. A system according to claim 1, wherein:

i. said parameter adjustment means includes means for controlling tonal quality of sound reaching said wearer; and ii. said indicator means includes means for visibly displaying an indication of said tonal quality.

11. A system according to claim 1, further comprising background noise filtration means.

12. A system according to claim 1, further comprising additional remote microphone means physically independent of said pair of microphones for being connected to said input unit and for being positioned independently of said pair of microphones so as to be able to sense substantially different sound from that sensed by said pair of microphones.

13. A system according to claim 1, wherein said segmented display is a LCD display.

14. A system according to claim 1, wherein said indicator means includes means for visibly displaying dynamic range of ambient sound sensed by the microphones.

15. A system according to claim 1, further comprising means to automatically control amplifier gain.

16. A system according to claim 1, further comprising means for selectively modifying amplification of desired frequencies of sound sensed by said microphones.

17. A system according to claim 1, wherein said sound input unit and said headphones are monophonic.

18. A hearing-aid system consisting essentially of:

a. a hand-held sound input unit including a pair of stereophonic microphones for sensing sound in an ambient environment, each of said microphones being connected to respective controllable amplifier means for controllably amplifying said sound sensed by said microphones;

b. a hand-held remote control unit connected to said input unit, said control unit having functional parameter adjustment means including a digital volume controller for discrete stepwise control of said amplifier means so as to provide a single amplified volume of sound to be supplied in said system, said digital volume controller having separate means for increasing and decreasing said volume, said separate means having two push-buttons, one push-button being for increasing said volume and the other being for decreasing said volume, respectively, said remote control unit also including volume indicator means for visibly displaying an indication of said single amplified volume of sound, said indicator means including a segmented, bar-type display for indicating the level of said single amplified volume of sound, said display including a plurality of bar segments and being adapted to display discrete, stepwise changes in level of said single amplified volume of sound generated by said amplifier means;

c. a first pair of stereophonic headphones for being were by a user, said headphones being connected to said system and receiving said single amplified volume of sound from said amplifier means; and d. means for connecting an additional pair of stereophonic headphones to said system in parallel with said first pair of headphones so that said additional pair of headphones receives said single amplified volume of sound received by said first pair of headphones;

and wherein said system is constructed such that said system is able to supply to said pairs of headphones only said single amplified volume of sound.

19. A system according to claim 18, wherein said sound input unit and said headphones are monophonic.

* * * * *

UNITED STATES PATENT AND TRADEMARK OFFICE

CERTIFICATE OF CORRECTION

PATENT NO. : 5,727,070

DATED : March 10, 1998

INVENTOR(S) : Paul Coninx

It is certified that error appears in the above-identified patent and that said Letters Patent is hereby corrected as shown below:

Claim 5, Col. 7, line 5, "simple" should be --single--.

Claim 18, Col. 8, line 32, "were" should be --worn--.

Signed and Sealed this

Thirteenth Day of October 1998

*Attest:*

*Attesting Officer*

BRUCE LEHMAN

*Commissioner of Patents and Trademarks*